US010024632B1

(12) United States Patent
Oglesby

(10) Patent No.: US 10,024,632 B1
(45) Date of Patent: Jul. 17, 2018

(54) ACCESSORY INTERFACE OR ATTACHMENT DEVICE

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/611,176

(22) Filed: Jun. 1, 2017

Related U.S. Application Data

(60) Provisional application No. 62/347,467, filed on Jun. 8, 2016.

(51) Int. Cl.

| | |
|---|---|
| ***F41G 11/00*** | (2006.01) |
| ***F41C 23/20*** | (2006.01) |
| *F41C 27/00* | (2006.01) |
| *F41C 23/16* | (2006.01) |

(52) U.S. Cl.
CPC ..... *F41G 11/003* (2013.01); *F41C 23/20* (2013.01); *F41G 11/006* (2013.01); *F41C 23/16* (2013.01); *F41C 27/00* (2013.01); *F41G 11/001* (2013.01)

(58) Field of Classification Search
CPC ..... F41G 1/38; F41G 1/387; F41G 11/001; F41G 11/003; F41G 11/004
USPC ..... 42/114, 115, 124, 127, 142
See application file for complete search history.

(56) References Cited

U.S. PATENT DOCUMENTS

2012/0198745 A1* 8/2012 Riley ..... F41C 27/00 42/90
2015/0068095 A1* 3/2015 Collin ..... F41G 11/003 42/90

FOREIGN PATENT DOCUMENTS

WO WO 2008111958 * 9/2008

* cited by examiner

*Primary Examiner* — Stephen Johnson
(74) *Attorney, Agent, or Firm* — Shaddock Law Group, PC

(57) ABSTRACT

An accessory attachment device having a main chassis; a first locking arm and a second locking arm extending from the main chassis; a channel defined between the first locking arm and the second locking arm; a rail clamp having a clamp extension, wherein the rail clamp is positionable in an extended or engaged position wherein at least a portion of the clamp extension extends through at least a portion of a rail clamp aperture formed in the second locking arm; a tension arm, wherein at least a portion of the tension arm is pivotably positioned within a chassis recess formed in the main chassis; and a cam lever having a cam lever extension portion, wherein at least a portion of the cam lever is pivotably positioned within the tension arm, and wherein the cam lever is pivotable between an open or unlocked position and a closed or locked position.

12 Claims, 13 Drawing Sheets

ACCESSORY INTERFACE OR ATTACHMENT DEVICE

CROSS-REFERENCE TO RELATED APPLICATIONS

This patent application claims the benefit of U.S. Patent Application Ser. No. 62/347,467, filed Jun. 8, 2016, the entire disclosure of which is incorporated herein by reference

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearm accessory mounting or attachment devices. More specifically, the present disclosure relates to accessory mounting or attachment apparatuses, systems, and methods for use with attachment rails, such as, for example, Picatinny rails.

2. Description of Related Art

It has become commonplace to attach a free floating or other tube or rail system to the upper receiver of a rifle or other firearm, to be used as a handguard. In most applications, the handguard is attached to the firearm so that it extends from an upper receiver of the firearm and surrounds at least a portion of the firearm barrel.

Typically, such handguard are formed from aluminum or other alloys because of the ease with which the material can be extruded, cut to length, and machined. Furthermore, aluminum offers great strength to weight properties and is robust enough for the most demanding of requirements.

Ofttimes, an upper portion of the firearm receiver and/or at least a portion of the handguard includes one or more substantially dovetail shaped attachment rails or rail attachment features, such as, for example, a Weaver rail, Picatinny or MIL-STD-1913 rail, a STANAG 2324 rail, or a tactical rail, that provides a mounting platform for various attachments and/or accessories. These rail attachment portions typically either run the entire length of the handguard or comprise rail attachment sections that are individually attached or secured to the handguard.

Accessory devices are provided with certain clamping arms that allow the devices to be clamped to the accessory portions.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

Unfortunately, known clamping arms do not offer sufficient adjustability and attachments may tend to slide, longitudinally, along the accessory rail. Additionally, known clamping arms typically include a rotating, frictional engagement portion that can cause the accessory to be marked and damaged.

The accessory interface or attachment device of the present disclosure overcomes these and other issues present in the current rail accessory interface or attachment systems and methods by providing an adjustable accessory attachment device for firearms, handguards accessories, attachments, accessory rails, and the like.

Unlike known designs, the accessory attachment device of the present disclosure does not mark or mar the accessory rail due to only engaging the accessory rail or accessory rail portion in a sideways, or lateral action. Furthermore, unlike other known designs, the accessory attachment device of the present disclosure is adjustable and can be adjusted after the cam lever is in the engaged or locked position and the accessory attachment device is attached to the accessory rail or accessory rail portion.

In various exemplary, nonlimiting embodiments, the accessory attachment device of the present disclosure comprises at least some of a cam lever that pushes against a rail clamp. The cam lever is pivotably retained within at least a portion of the tension arm, via a cam lever pivot pin.

The rail clamp is spring biased in the disengaged or unlocked position. The cam lever pushes the rail clamp into the locked position against the attachment rail or attachment rail portion. The cam lever is held within a pivoting and floating tension arm that is also spring biased, meaning that the cam lever and rail clamp position can vary in depth and/or position to match the size of the attachment rail or attachment rail portion.

In various exemplary, nonlimiting embodiments, the tension arm can be adjusted by tightening or loosening a threaded tension screw and can, in certain exemplary embodiments, be locked up completely.

Within a channel defined or formed between a first locking arm and a second locking arm is a spacer lug, or rail engagement protrusion. In various exemplary embodiments, the spacer lug is split partially and can engage with a spacer lug expansion screw that, when tightened, "spreads" a section the spacer lug causing at least a portion of the spacer lug to expand to provide a more precise frictional fit within a recoil groove of an attachment rail or attachment rail portion.

The cam lever further comprises a lever lock catch that is pivotably maintained within at least a portion of the tension arm, via a lever lock catch pivot pin. The lever lock catch is spring biased to automatically engage a portion of the cam lever when the cam lever is pivoted to its fully engaged or locked position. In various exemplary embodiments, the lever lock catch utilizes a torsion spring to provide the spring biasing force and engages with a lock notch on the cam lever. In order to pivot the cam lever the lever lock catch has to be pushed or pivoted out of the way. The lever lock catch and cam lever assembly are attached or coupled within at least a portion of the spring biased tension arm.

The tension arm assembly fits at least partially within a chassis recess of the main chassis and is pivotably retained within the chassis recess, via the tension arm pivot pin.

The tension arm also retains the tension arm pivot pin that the tension arm pivots or pivots around. In various exemplary embodiments, the tension arm pivot pin is inwardly tapered so that the tension arm pivot pin is thinner in the middle as compared to the top and bottom. A hook or protrusion is formed proximate one end of the tension arm that is outwardly tapered (so as to at least partially made with the inwardly tapered portion of the tension arm pivot pin), meaning that, when engaged, the tension arm pivot pin cannot move vertically with relation to the tension arm and therefore cannot fall out of the tension arm assembly.

In various exemplary, nonlimiting embodiments, the accessory attachment device of the present disclosure comprises at least some of a main chassis; a first locking arm and a second locking arm extending from the main chassis; a channel defined between the first locking arm and the second locking arm; a rail clamp having a clamp extension, wherein the rail clamp is slidably positioned within at least a portion of a rail clamp aperture formed through the second locking arm, and wherein the rail clamp is slidable between an extended or engaged position wherein at least a portion of the clamp extension extends through at least a portion of the rail clamp aperture and a retracted or disengaged position wherein the clamp extension is at least partially retracted from the channel; a tension arm, wherein at least a portion of the tension arm is pivotably positioned within a chassis recess formed in at least a portion of the main chassis; and a cam lever having a cam lever extension portion, wherein at least a portion of the cam lever is pivotably positioned within the tension arm, wherein the cam lever is pivotable between an open or unlocked position and a closed or locked position, and wherein if the cam lever is pivoted toward the closed or locked position, the cam lever extension portion is urged against the rail clamp and the clamp extension is urged into the channel.

In certain exemplary, nonlimiting embodiments, if the cam lever is pivoted toward the open or unlocked position, the cam lever extension portion is urged away from the rail clamp and the clamp extension is at least partially retracted from the channel.

In certain exemplary, nonlimiting embodiments, if the cam lever is pivoted toward the open or unlocked position, the cam lever extension portion is urged away from the rail clamp and the clamp extension is fully retracted from the channel.

In various exemplary, nonlimiting embodiments, the accessory attachment device of the present disclosure further comprises a spacer lug positioned within the channel, wherein the spacer lug can be engaged by a spacer lug expansion screw such that if the spacer lug expansion screw is tightened, at least a portion of the spacer lug expands.

In various exemplary, nonlimiting embodiments, the accessory attachment device of the present disclosure further comprises a spacer lug positioned within the channel, wherein the spacer lug comprises a spacer lug expansion slot formed through at least a portion of the spacer lug, and wherein the spacer lug can be engaged by a spacer lug expansion screw such that if the spacer lug expansion screw is tightened, at least a portion of the spacer lug proximate the spacer lug expansion slot expands.

In various exemplary, nonlimiting embodiments, the accessory attachment device of the present disclosure further comprises a spacer lug positioned within the channel, wherein the spacer lug comprises a resilient portion of material, and wherein the spacer lug can be engaged by a spacer lug expansion screw such that if the spacer lug expansion screw is tightened, at least a portion of the spacer lug expands.

In various exemplary, nonlimiting embodiments, the accessory attachment device of the present disclosure further comprises a spacer lug positioned within the channel, and wherein the spacer lug comprises a shear expansion element and a spacer lug element and wherein the shear expansion element can be engaged by a spacer lug expansion screw such that if the spacer lug expansion screw is tightened, adjacent, angled planes or surfaces of the spacer lug element and the shear expansion element interact to expand the expandable spacer lug.

In various exemplary, nonlimiting embodiments, the accessory attachment device of the present disclosure comprises at least some of a main chassis; a first locking arm and a second locking arm extending from the main chassis; a channel defined between the first locking arm and the second locking arm; a rail clamp having a clamp extension, wherein the rail clamp is slidably positioned within at least a portion of a rail clamp aperture formed through the second locking arm, and wherein the rail clamp is slidable between an extended or engaged position wherein at least a portion of the clamp extension extends through at least a portion of the rail clamp aperture and a retracted or disengaged position wherein the clamp extension is at least partially retracted from the channel; and a cam lever having a cam lever extension portion, wherein at least a portion of the cam lever is pivotably positioned relative to the main chassis, wherein the cam lever is pivotable between an open or unlocked position and a closed or locked position, and wherein if the cam lever is pivoted toward the closed or locked position, the cam lever extension portion is urged against the rail clamp and the clamp extension is urged into the channel.

In various exemplary, nonlimiting embodiments, the accessory attachment device of the present disclosure comprises at least some of a main chassis; a first locking arm and a second locking arm extending from the main chassis; a channel defined between the first locking arm and the second locking arm; a rail clamp having a clamp extension, wherein the rail clamp is slidably positioned within at least a portion of a rail clamp aperture formed through the second locking arm, and wherein the rail clamp is slidable between an extended or engaged position wherein at least a portion of the clamp extension extends through at least a portion of the rail clamp aperture and a retracted or disengaged position wherein the clamp extension is at least partially retracted from the channel; a cam lever having a cam lever extension portion, wherein at least a portion of the cam lever is pivotably positioned relative to the main chassis, wherein the cam lever is pivotable between an open or unlocked position and a closed or locked position, and wherein if the cam lever is pivoted toward the closed or locked position, the cam lever extension portion is urged against the rail clamp and the clamp extension is urged into the channel; and a spacer lug, wherein the spacer lug is positioned within the channel, and wherein the spacer lug can be engaged by a spacer lug expansion screw such that if the spacer lug expansion screw is tightened, at least a portion of the spacer lug expands.

Accordingly, the presently disclosed system separately provides an accessory attachment device for an accessory rail or accessory rail portion.

The presently disclosed system separately provides an accessory attachment device that engages an accessory rail or accessory rail portion in a horizontal or lateral action.

The presently disclosed system separately provides an accessory attachment device that is adjustable.

The presently disclosed system separately provides an accessory attachment device that can be adjusted after the cam lever is in the engaged or locked position and the accessory attachment device is attached to the accessory rail or accessory rail portion.

These and other aspects, features, and advantages of the present disclosure are described in or are apparent from the following portion detailed description of the exemplary, non-limiting embodiments of the present disclosure and the accompanying figures. Other aspects and features of embodiments of the present disclosure will become apparent to those of ordinary skill in the art upon reviewing portion the following portion description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present systems are disclosed herein; however, it is to be understood that the disclosed embodiments are merely exemplary of the disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of this disclosure will be described in detail, with reference to the following portion figures, wherein like reference numerals refer to like parts throughout the several views, and wherein.

DETAILED DESCRIPTION OF THE PRESENT DISCLOSURE

Figure 1:
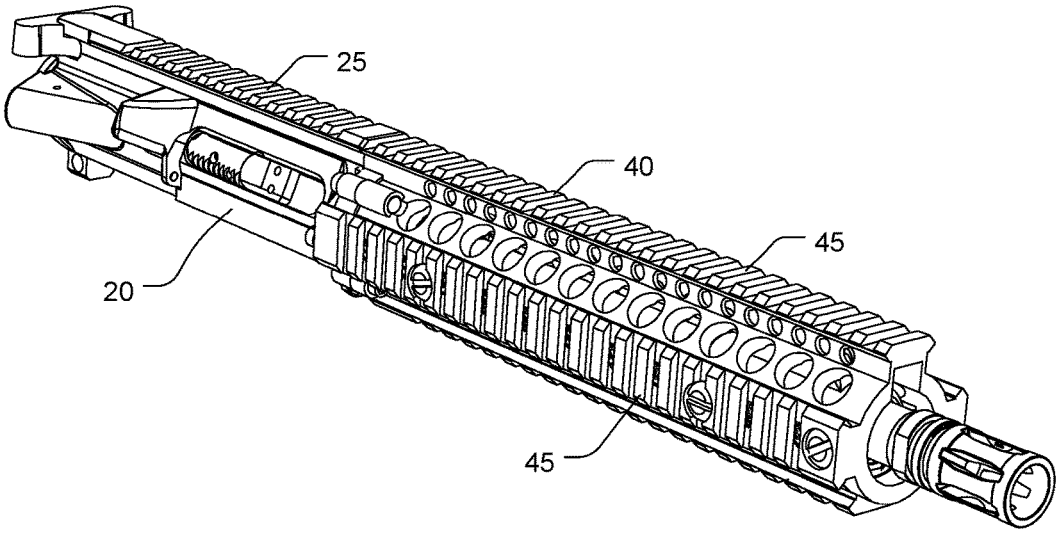
FIG. 1 PRIOR ART
FIG. 1 illustrates a perspective view of certain components of an AR-15 style upper receiver, having an attached, free float handguard.
Figure 2:
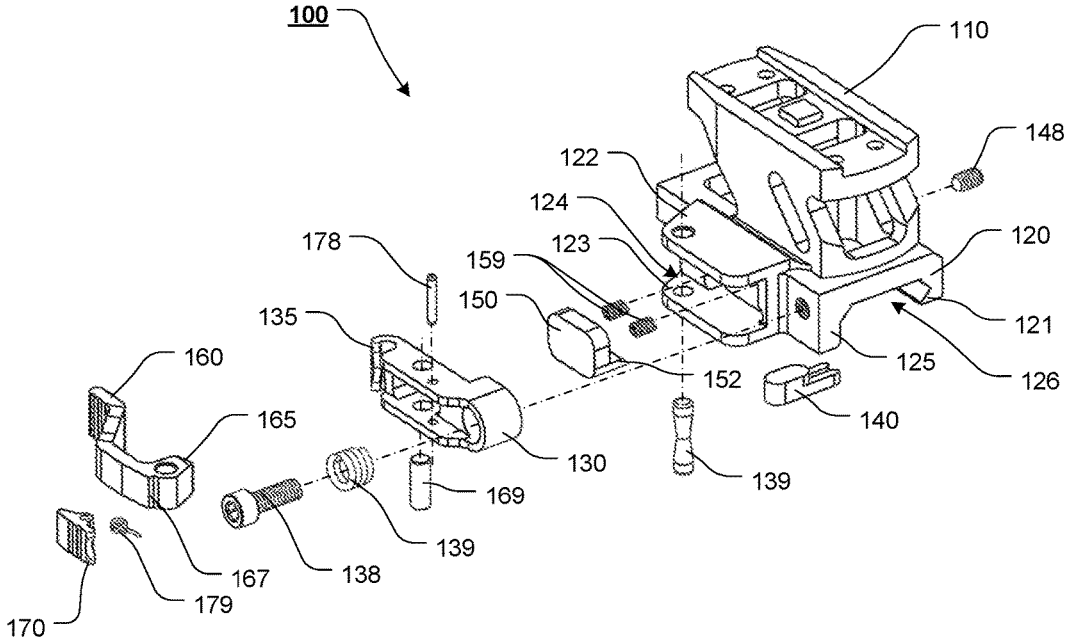
FIG. 2 illustrates an exploded, perspective view of an exemplary embodiment of an accessory attachment device, according to the present disclosure.
Figure 3:
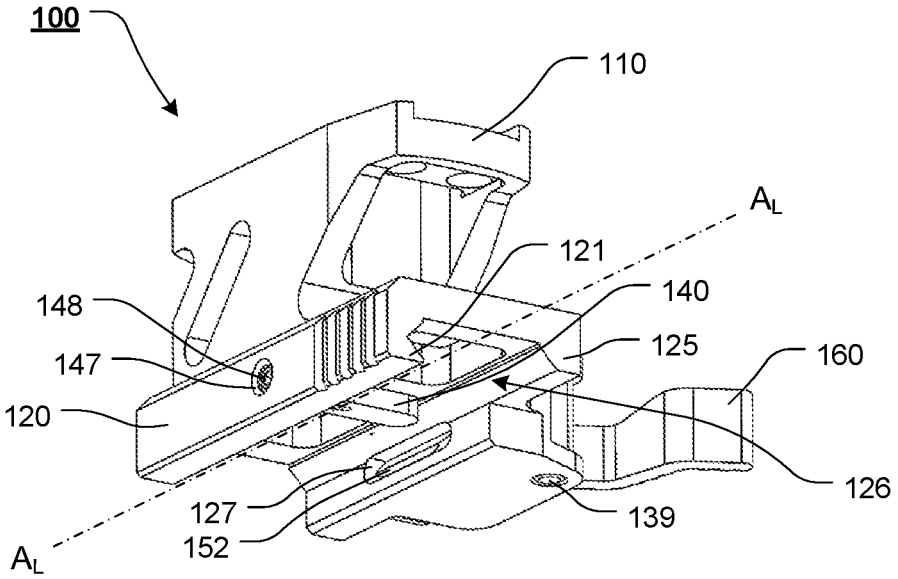
FIG. 3 illustrates a lower, perspective view of an exemplary embodiment of an accessory attachment device, wherein the cam lever is illustrated in an open or unlocked position and the rail clamp is illustrated in a retracted or disengaged position, according to the present disclosure.
Figure 4:
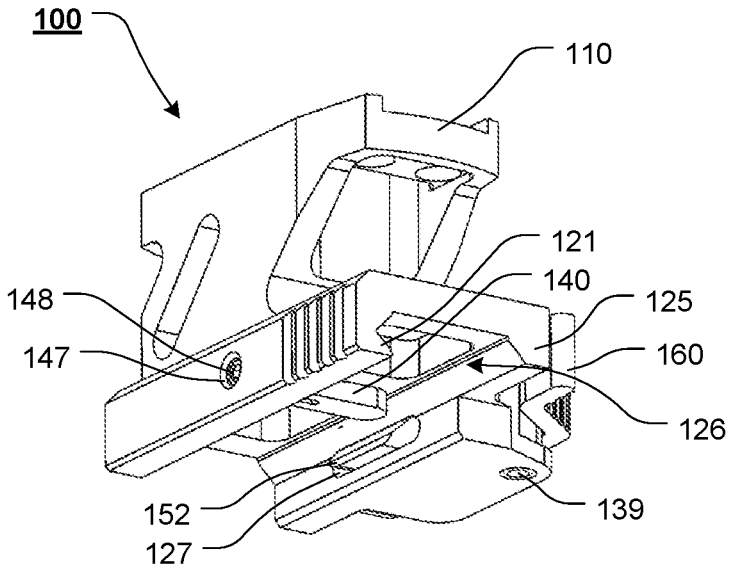
FIG. 4 illustrates a lower, perspective view of an exemplary embodiment of an accessory attachment device, wherein the cam lever is illustrated in a closed or locked position and the rail clamp is illustrated in an extended or engaged position, according to the present disclosure.
Figure 5:
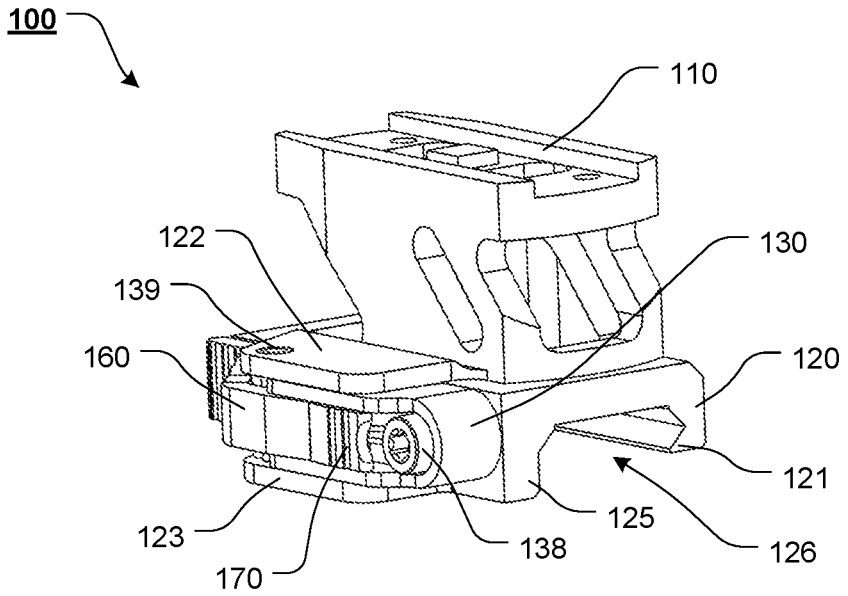
FIG. 5 illustrates a front, perspective view of an exemplary embodiment of an accessory attachment device, wherein the cam lever is illustrated in a closed or locked position, according to the present disclosure.
Figure 6:
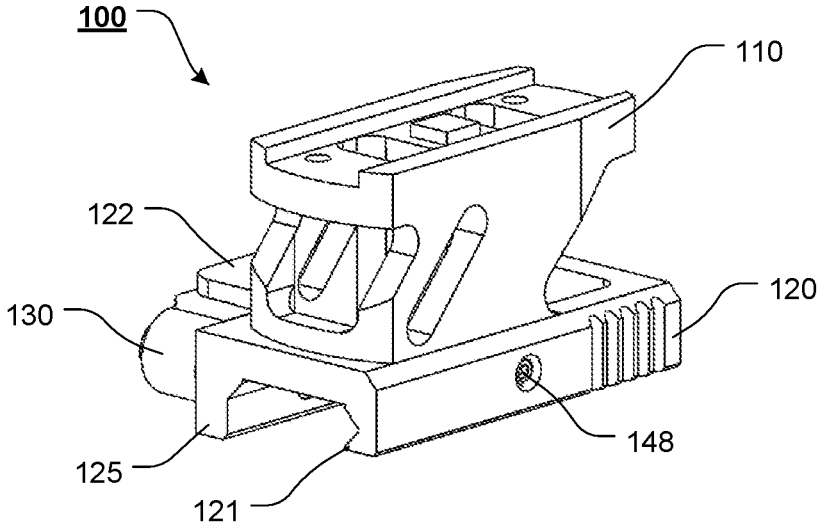
FIG. 6 illustrates a rear, perspective view of an exemplary embodiment of an accessory attachment device, wherein the cam lever is illustrated in a closed or locked position, according to the present disclosure.
Figure 7:
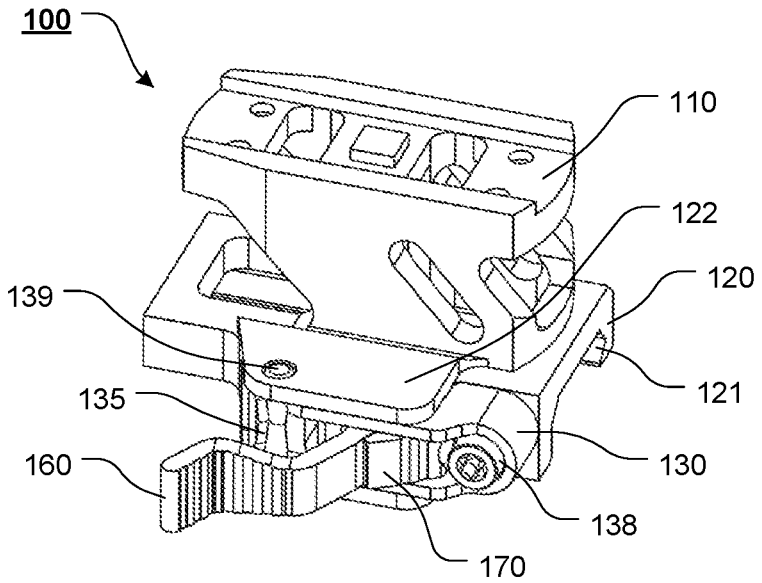
FIG. 7 illustrates an upper, perspective view of an exemplary embodiment of an accessory attachment device, wherein the cam lever is illustrated in an open or unlocked position, according to the present disclosure.
Figure 8:
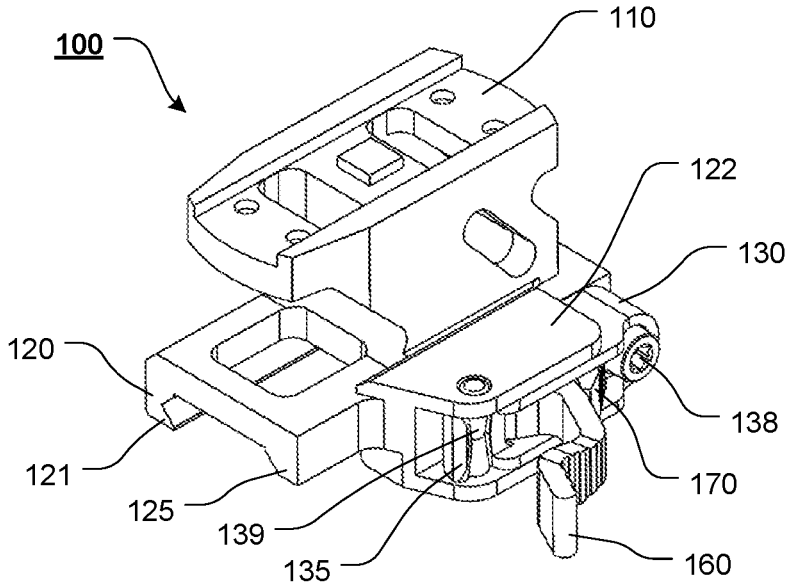
FIG. 8 illustrates an upper, perspective view of an exemplary embodiment of an accessory attachment device, wherein the cam lever is illustrated in an open or unlocked position, according to the present disclosure.
Figure 9:
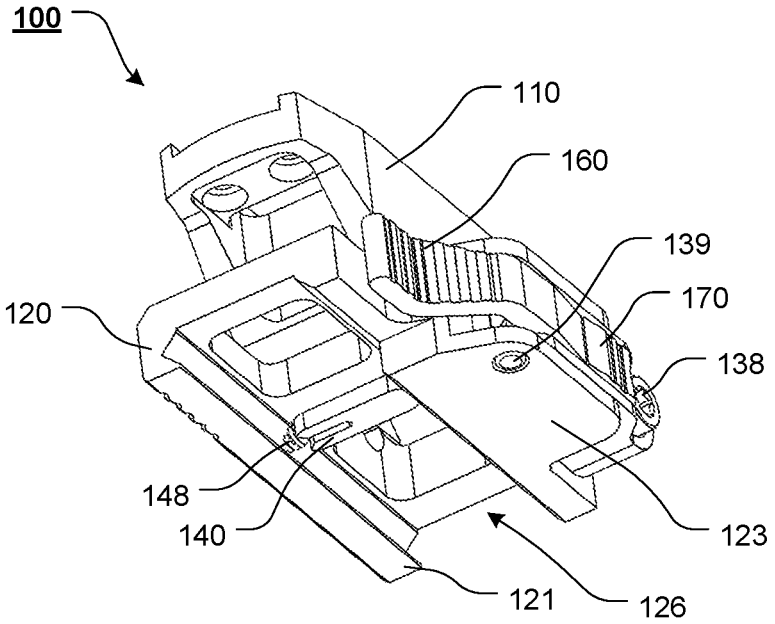
FIG. 9 illustrates a lower, perspective view of an exemplary embodiment of an accessory attachment device, wherein the cam lever is illustrated in a closed or locked position, according to the present disclosure.
Figure 10:
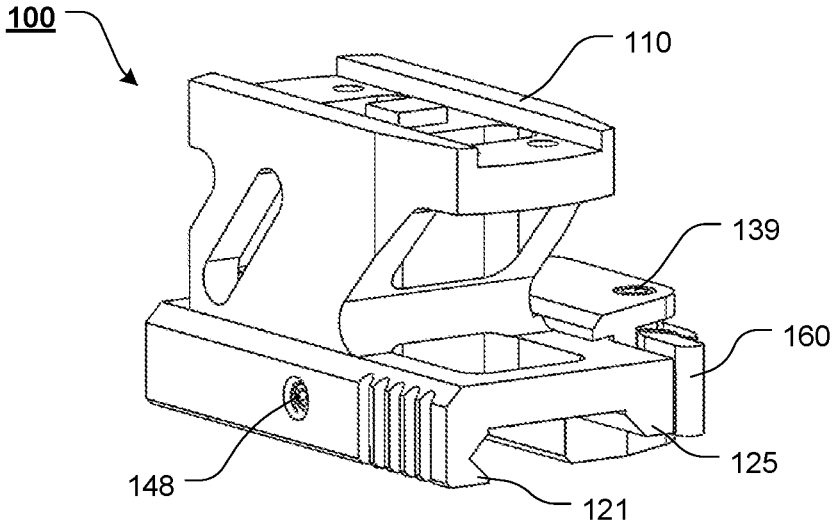
FIG. 10 illustrates a rear, perspective view of an exemplary embodiment of an accessory attachment device, wherein the cam lever is illustrated in a closed or locked position, according to the present disclosure.
Figure 11:
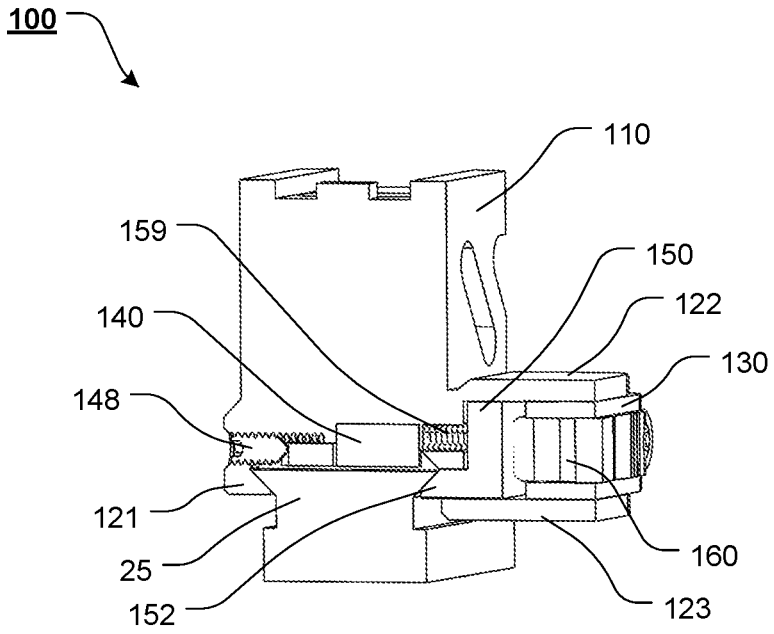
FIG. 11 illustrates a cross-sectional, perspective view of an exemplary embodiment of an accessory attachment device, wherein the cam lever is illustrated in a closed or locked position and the rail clamp is illustrated in an extended or engaged position, according to the present disclosure.
Figure 12:
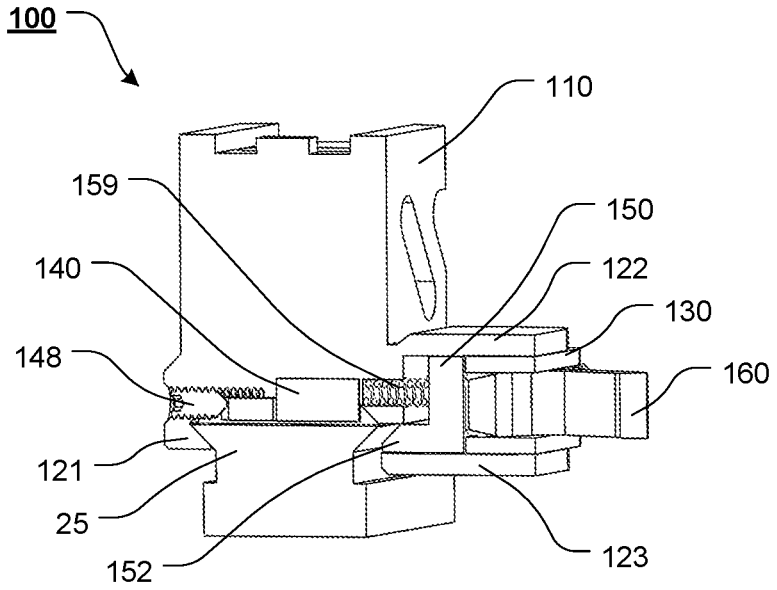
FIG. 12 illustrates a cross-sectional, perspective view of an exemplary embodiment of an accessory attachment device, wherein the cam lever is illustrated in an open or unlocked position and the rail clamp is illustrated in a retracted or disengaged position, according to the present disclosure.
Figure 13:
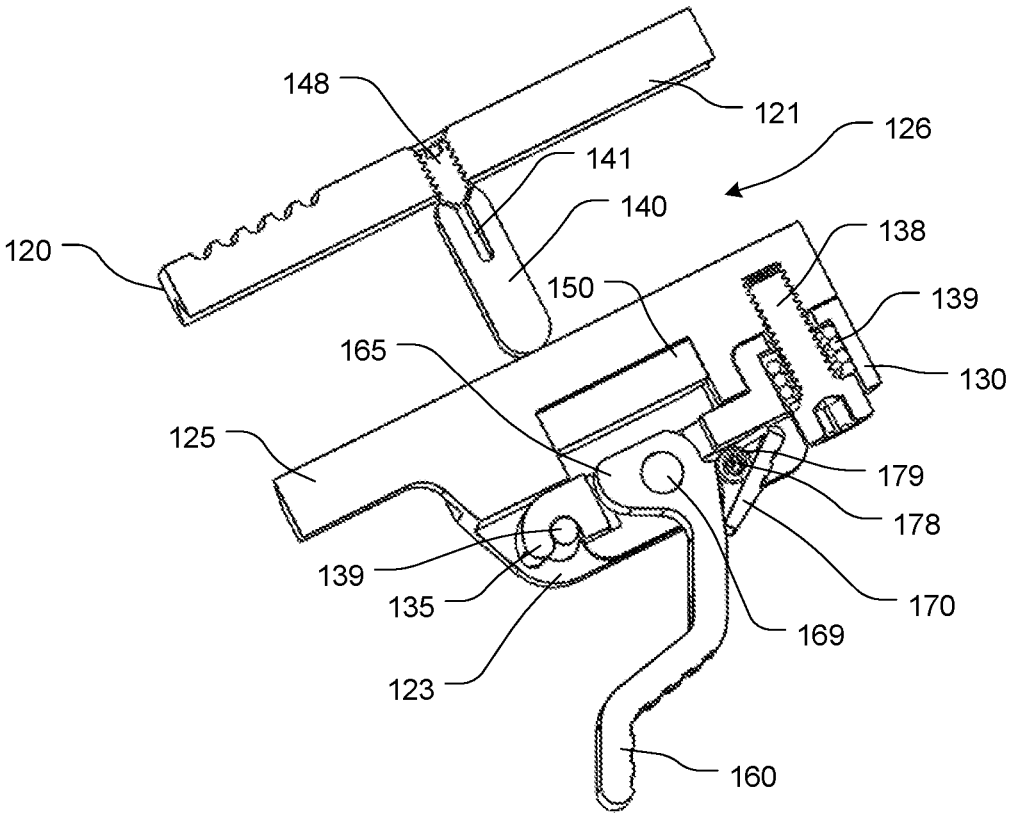
FIG. 13 illustrates an upper, cross-sectional, perspective view of an exemplary embodiment of an accessory attachment device, wherein the cam lever is illustrated in an open or unlocked position, according to the present disclosure.
Figure 14:
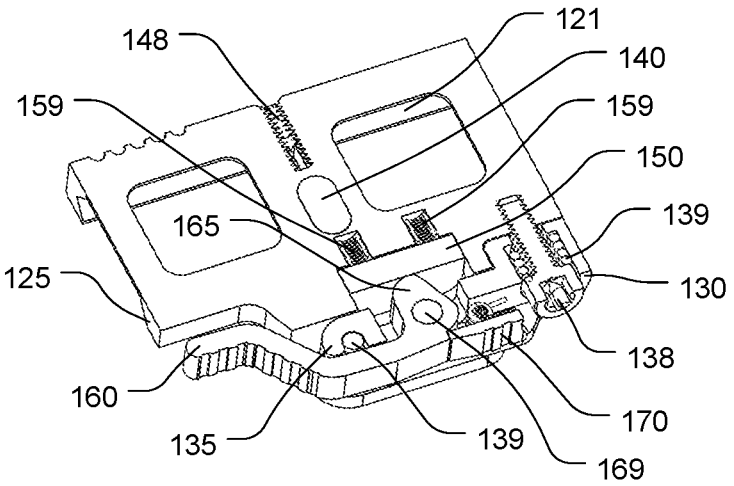
FIG. 14 illustrates an upper, cross-sectional, perspective view of an exemplary embodiment of an accessory attachment device, wherein the cam lever is illustrated in a closed or locked position and the rail clamp is illustrated in an extended or engaged position, according to the present disclosure.
Figure 15:
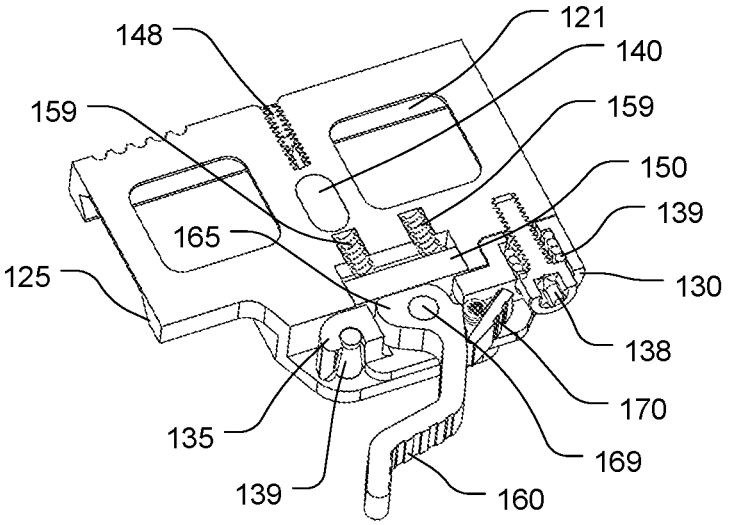
FIG. 15 illustrates an upper, cross-sectional, perspective view of an exemplary embodiment of an accessory attachment device, wherein the cam lever is illustrated in an open or unlocked position and the rail clamp is illustrated in a retracted or disengaged position, according to the present disclosure.
Figure 16:
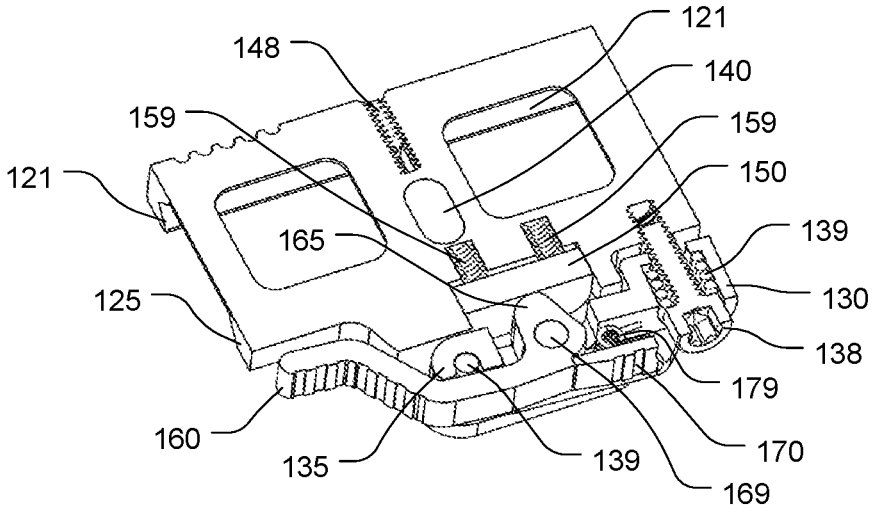
FIG. 16 illustrates an upper, cross-sectional, perspective view of an exemplary embodiment of an accessory attachment device, wherein the cam lever is illustrated in a closed or locked position and the tension screw is illustrated in a loosened position, according to the present disclosure.
Figure 17:
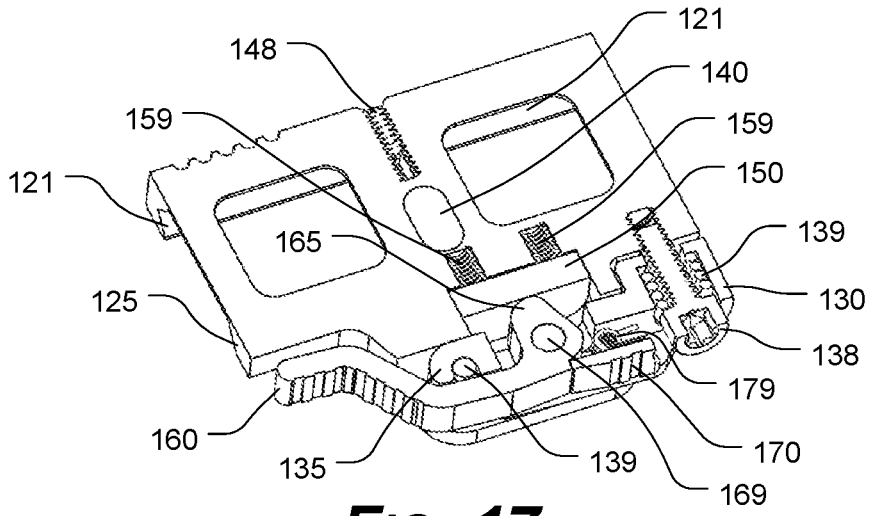
FIG. 17 illustrates an upper, cross-sectional, perspective view of an exemplary embodiment of an accessory attachment device, wherein the cam lever is illustrated in a closed or locked position and the tension screw is illustrated in a tightened position, according to the present disclosure.
Figure 18:
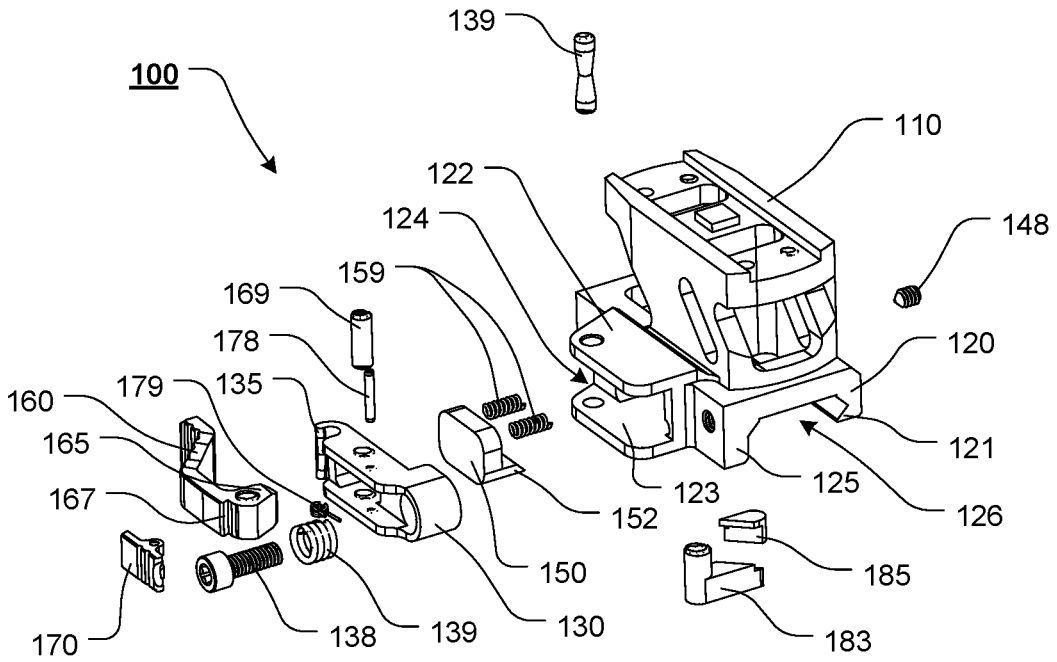
FIG. 18 illustrates an upper, exploded, perspective view of an exemplary embodiment of an accessory attachment device, according to the present disclosure.
Figure 19:
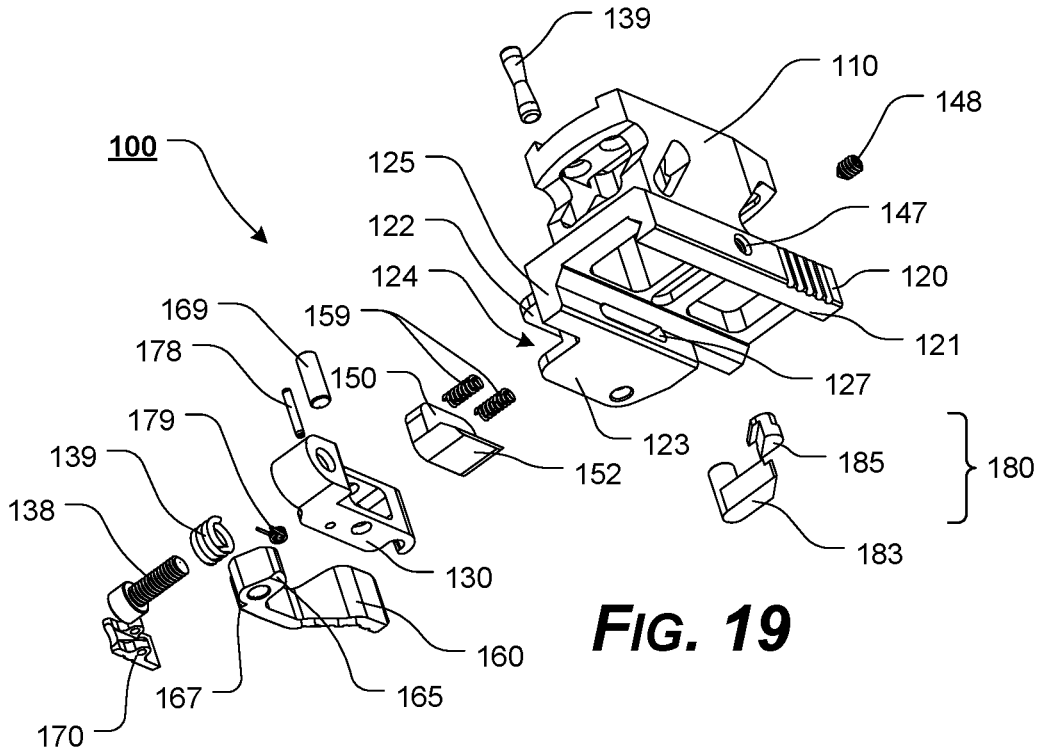
FIG. 19 illustrates a lower exploded, perspective view of an exemplary embodiment of an accessory attachment device, according to the present disclosure.
Figure 20:
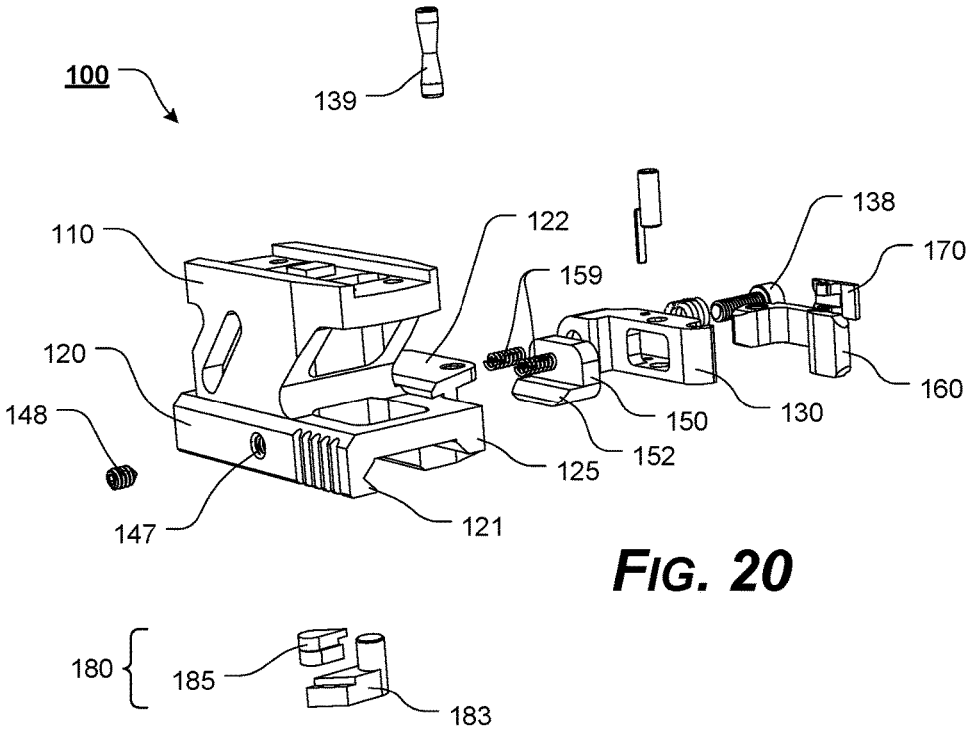
FIG. 20 illustrates an exploded, perspective view of an exemplary embodiment of an accessory attachment device, according to the present disclosure.
Figure 21:
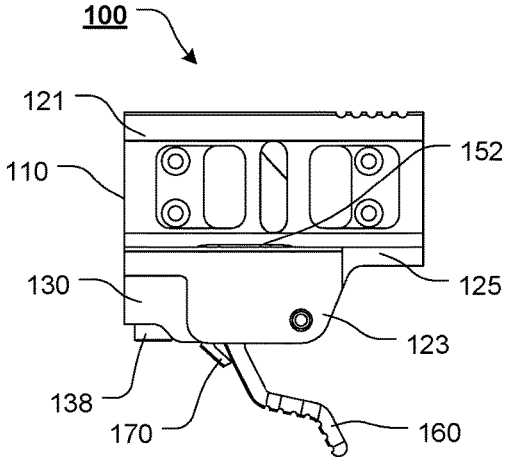
FIG. 21 illustrates a bottom view of an exemplary embodiment of an accessory attachment device wherein the cam lever is illustrated in an open or unlocked position according to the present disclosure.
Figure 22:
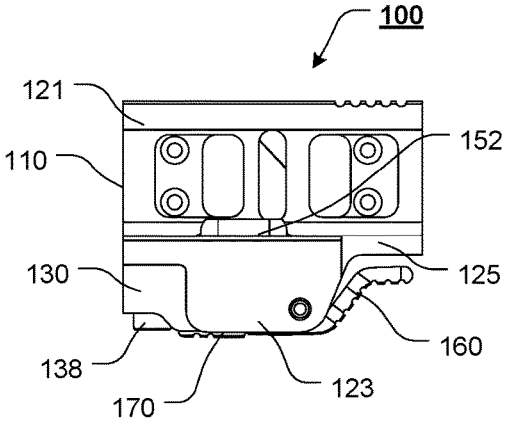
FIG. 22 illustrates a bottom view of an exemplary embodiment of an accessory attachment device wherein the cam lever is illustrated in a closed or locked position according to the present disclosure.
Figure 23:
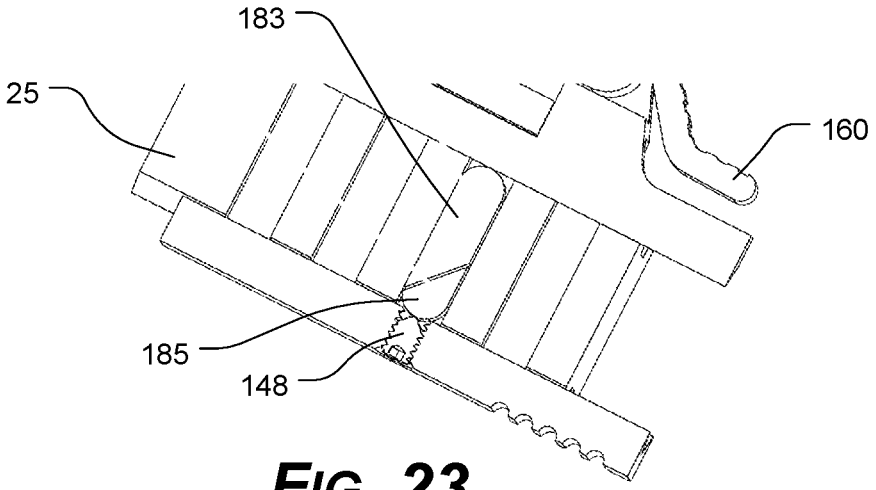
FIG. 23 illustrates an upper, cross-sectional, perspective view of an exemplary embodiment of an accessory attachment device, illustrating an exemplary embodiment of an expandable spacer lug, according to the present disclosure.
Figure 24:
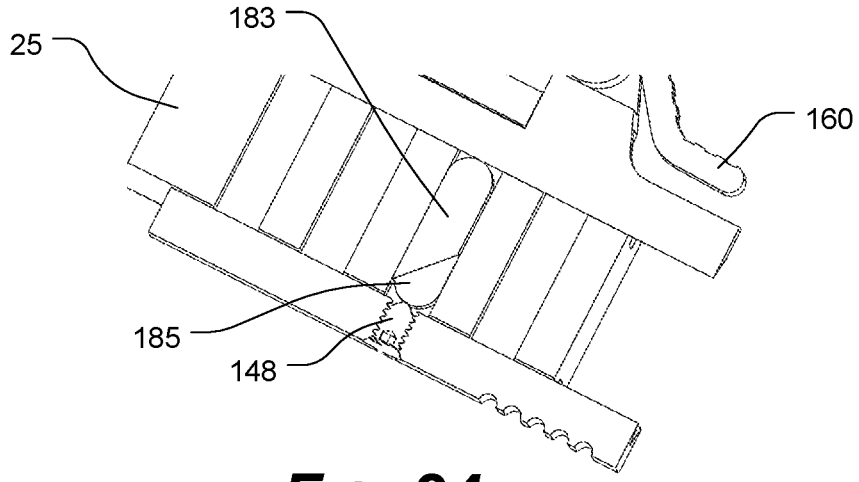
FIG. 24 illustrates an upper, cross-sectional, perspective view of an exemplary embodiment of an accessory attachment device, illustrating an exemplary embodiment of an expandable spacer lug, according to the present disclosure.

For simplicity and clarification, the design factors and operating principles of the accessory attachment device according to the present disclosure are explained with reference to various exemplary embodiments of an accessory attachment device according to the present disclosure. The basic explanation of the design factors and operating principles of the accessory attachment device is applicable for the understanding, design, and operation of the present disclosure. It should be appreciated that the present disclosure can be adapted to many applications where removable attachment of accessories or other devices is desired.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "accessory" and "accessory attachment device" are used for basic explanation and understanding of the operation of the systems, methods, and apparatuses of this disclosure. Therefore, the terms "accessory" and "accessory attachment device" are not to be construed as limiting the systems, methods, and apparatuses of this disclosure. Thus, for example, the term "accessory" is to be understood to broadly include any accessory or device capable of being attached or coupled to an object.

For simplicity and clarification, the accessory attachment device of this disclosure will be described as being used in conjunction with a Picatinny rail portion of a handguard for a firearm, such as a rifle or carbine. However, it should be appreciated that these are merely exemplary embodiments of the accessory attachment device and are not to be construed as limiting this disclosure.

Turning now to the drawing portion FIGS., FIG. 1 illustrates certain components of an AR-15 style upper receiver 20, having an attached, free float handguard 40.

Generally, a barrel is aligned with and inserted into the upper receiver 20. A gas tube extends between the upper receiver 20 and a gas block. A muzzle device, such as a flash hider, flash suppressor, compensator, or muzzle brake is typically secured to the barrel.

While not illustrated in FIG. 1, the barrel is typically secured to the upper receiver 20 via interaction of a threaded portion of the upper receiver 20 and an internally threaded barrel nut.

The free float handguard 40 is typically attached to the standard barrel nut, a modified barrel nut, or the threaded portion of the upper receiver 20. As illustrated, the handguard 40 includes Picatinny rail portions or attachment rail portions 45 that extend along substantially the entire length of the handguard 40 at the 12 o'clock, 3 o'clock, 6 o'clock, and 9 o'clock positions. An attachment rail portion 25 is also included atop at least a portion of the upper receiver 20.

The Picatinny rail or accessory rail generally comprises an elongate rail section having a low, wide "T" or dovetail cross-section, typically with multiple, transverse recoil grooves formed at spaced apart locations along the accessory rail. A variety of accessories or attachments can be attached to or interface with the Picatinny or accessory rail.

It should also be appreciated that a more detailed explanation of the components of the upper receiver 20, lower receiver, barrel, barrel nut, gas tube, gas block, muzzle device, free float handguard 40, and picatinny or accessory rail, instructions regarding how to attach and/or remove the various components and other items and/or techniques necessary for the implementation and/or operation of the various components of the AR-15 platform are not provided herein because such components are commercially available and/or such background information will be known to one of ordinary skill in the art. Therefore, it is believed that the level of description provided herein is sufficient to enable one of ordinary skill in the art to understand and practice the present disclosure as described.

FIGS. 2-17 illustrate certain elements and/or aspects of an exemplary embodiment of an accessory attachment device 100, according to the present disclosure. As illustrated in FIGS. 2-17, the accessory attachment device 100 comprises at least some of a main chassis 110 having a chassis recess 124 defined between two main chassis wing 122 and 123. The chassis recess 124 is formed so as to receive at least a portion of a tension arm 130 such that the tension arm 130 can be pivotably attached, via a tension arm pivot pin 138, within the chassis recess 124, between the two main chassis wing 122 and 123.

A first locking arm 120 and a second locking arm 125 extend from the main chassis 110. The first locking arm 120 includes a locking claw 121 extending from at least a portion of the first locking arm 120. In various exemplary, nonlimiting embodiments, the locking claw 121 is formed of a continuous extension from the first locking arm 120. Alternatively, the locking claw 121 may be formed of one or more spaced apart segments extending from the first locking arm 120. The locking claw 121 is formed so as to allow a side portion of an accessory rail to be at least partially received within the locking claw 121 and frictionally engaged by at least a portion of the locking claw 121.

A channel 126 is defined or formed between the first locking arm 120 and the second locking arm 125. The channel 126 is formed so as to be wide enough to accept at least a portion of an accessory rail, such as, for example, accessory rail 25 or 45, within the channel 126 such that one side portion of the accessory rail is at least partially received within the locking claw 121 of the first locking arm 120 and an opposing side portion of the accessory rail is positioned adjacent the second locking arm 125.

In various exemplary, nonlimiting embodiments, an at least partially expandable spacer lug 140 is removably positioned within the channel 126, substantially perpendicular to a longitudinal axis, $A_L$, of the channel 126. In certain exemplary embodiments, the spacer lug 140 is split partially and can engage with a spacer lug expansion screw 148 that, when tightened, "spreads" a section the spacer lug 140 causing at least a portion of the spacer lug 140 to expand to provide a more precise frictional fit within a recoil groove of an attachment rail or attachment rail portion. The spacer lug expansion screw 148 is positioned within a threaded aperture 147 formed through the first locking arm 120. In various exemplary embodiments, the spacer lug 140 includes a spacer lug expansion slot 141, formed through at least a portion of the spacer lug 140. The spacer lug expansion slot 141, if included, allows at least a portion of the spacer lug 140 to expand. Alternatively, the spacer lug 140 comprises a resilient portion of material, which can resiliently expand, when engaged by the spacer lug expansion screw 148.

By threadedly inserting the spacer lug expansion screw 148 within the threaded aperture 147, at least a portion of the spacer lug 140 is spread apart or expanded. While positioned within a recoil groove of the accessory rail, at least a portion of the spacer lug 140 can be expanded within a recoil groove to further secure the spacer lug 140 within the recoil groove. In this manner, longitudinal, or front to back, movement of the accessory attachment device 100 along the accessory rail can be reduced or eliminated.

A rail clamp aperture 127 is formed through at least a portion of the second locking arm 125. In various exemplary embodiments, a longitudinal axis of the rail clamp aperture 127 is substantially perpendicular to the longitudinal axis of the channel 126. The rail clamp aperture 127 is formed so as to slidably receive at least a portion of a clamp extension 152 of a rail clamp 150 within at least a portion of the rail clamp aperture 127. An exterior portion of the rail clamp 150 and/or the clamp extension 152 is sized so as to be slidably received within at least a portion of the rail clamp aperture 127, such that horizontal or vertical movement of the rail clamp 150 and/or the clamp extension 152 within the rail clamp aperture 127 (other than slidable movement through the rail clamp aperture 127) is minimized.

In various exemplary, nonlimiting embodiments, the rail clamp 150 comprises a substantially L-shaped portion of material with a clamp extension 152 extending from the main body of the rail clamp 150. In various exemplary embodiments, a terminating portion of the clamp extension 152 is angled or formed so as to parallel at least a portion of a side portion of an accessory rail, so as to be positioned against a side portion of an accessory rail.

In various exemplary embodiments, the rail clamp 150 is positioned within at least a portion of the chassis recess 124 and is spring biased by, for example, one or more springs or spring biasing elements 159, toward a retracted or disengaged position, wherein the clamp extension 152 is at least partially or fully retracted from the channel 126.

When the spring bias of the spring biasing elements 159 is overcome, the rail clamp 150 can be urged toward the main chassis 110 such that at least a portion of the clamp extension 152 extends into the channel 126. When the clamp extension 152 of the rail clamp 150 is urged a sufficient distance into the channel 126, the rail clamp 150 is in an extended or engaged position, wherein at least a terminal end of the clamp extension 152 contacts a side portion of an inserted accessory rail and urges the inserted accessory rail toward the locking claw 121 of the first locking arm 120.

The rail clamp 150 is retained within the chassis recess 124, via interaction with at least a portion of the tension arm 130. The tension arm 130 (and the tension arm 130 assembly) fits at least partially within a chassis recess 124 of the main chassis 110 and is pivotably retained within the chassis recess 124, via the tension arm pivot pin 138.

The tension arm 130 also retains the tension arm pivot pin 138 that the tension arm 130 pivots. In various exemplary embodiments, the tension arm pivot pin 138 is inwardly tapered so that the tension arm pivot pin 138 is thinner in a middle portion as compared to a top portion and a bottom portion. A hook or protrusion 135 is formed proximate one end of the tension arm 130 that is outwardly tapered (so as to at least partially made with the inwardly tapered portion of the tension arm pivot pin 138), meaning that, when engaged, the tension arm pivot pin 138 cannot move vertically with relation to the tension arm 130 and therefore cannot fall out of the tension arm 130 assembly.

In various exemplary, nonlimiting embodiments, a distance between at least a portion of the tension arm 130 and the main chassis 110 can be adjusted by tightening or loosening a threaded tension screw 138 and can, in certain exemplary embodiments, be locked up completely. By varying the distance between at least a portion of the tension arm 130 and the main chassis 110, the distance that the rail clamp 150 travels, in relation to the main chassis 110 (and the distance that the clamp extension 152 extends into the channel 126) can be adjusted, thereby adjusting the amount of clamping force applied to an accessory rail portion inserted within the channel 126. In certain exemplary embodiments, at least one tensioning spring 139 is positioned around the threaded tension screw 138 so as to provide an amount of spring tension to spring bias the tension arm 130 to a closed position.

The tension screw 138 can be rotated to adjust the amount of tension applied to the rail clamp 150 when the cam lever 160 is in the open or unlocked position or in the closed or locked position. In this manner, the frictional engagement or clamping force provided between the clamp extension 152 and the locking claw 121 may be adjusted to accommodate varying width accessory attachment rails or out of spec or worn rails.

The cam lever 160 is held within a pivoting and floating tension arm 130 that is also spring biased, meaning that the cam lever 160 and rail clamp 150 position can vary in depth and/or position to match the size of the attachment rail or attachment rail portion. The cam lever 160 is pivotably retained within at least a portion of the tension arm 130, via a cam lever pivot pin 169.

In a closed or locked position, the cantilever cam lever extension portion 165 is rotated against the rail clamp 150 and progressively urges the rail clamp 150 into the extended or engaged position against the attachment rail or attachment rail portion. When the cam lever 160 is pivoted to the open or unlocked position, the cam lever extension portion 165 is pivoted away from the rail clamp 150 and the spring bias of the spring biasing elements 159 urges the rail clamp 150 to the retracted or disengaged position. Thus, as the cam lever 160 is pivoted toward the closed or locked position, the cam lever extension portion 165 is progressively urged against the rail clamp 150 and the clamp extension 152 is urged further into the channel 126. Alternatively, when the cam lever 160 is pivoted toward the open or unlocked position, the cam lever extension portion 165 is urged further away from the rail clamp 150 and the clamp extension 152 is retracted from the channel 126.

In various exemplary embodiments, the cam lever 160 interacts with a lever lock catch 170 that is pivotably maintained within at least a portion of the tension arm 130, via a lever lock catch pivot pin 178. The lever lock catch 170 is spring biased to automatically engage a portion of the cam lever 160 when the cam lever 160 is pivoted to the closed or locked position. In various exemplary embodiments, the lever lock catch 170 utilizes a torsion spring 179 to provide the spring biasing force and engages with a lock notch 167 on the cam lever 160. In order to pivot the cam lever 160 the lever lock catch 170 has to be pushed or pivoted out of the way. The lever lock catch 170 and cam lever 160 assembly are attached or coupled within at least a portion of the spring biased tension arm 130.

FIGS. 18-24 illustrate certain elements and/or aspects of an exemplary embodiment of an expandable spacer lug 180, according to the present disclosure. As illustrated in FIGS. 18-24, the expandable spacer lug 140 is replaced by an expandable spacer lug 180 comprising a shear lug element 183 and a shear expansion element 185. As illustrated, the shear lug element 183 and the shear expansion element 185 are positionable within a recoil groove of an accessory attachment rail.

The shear lug element 183 is maintained in a fixed position relative to the main chassis 110. In various exemplary embodiments, the shear lug element 183 is maintained in a fixed position via interaction of a pin or extension of the shear lug element 183 and a corresponding or mating recess or aperture of the main chassis 110.

The shear expansion element 185 is positioned adjacent the shear lug element 183. The shear expansion element 185 and the shear lug element 183 include angled surfaces that interact with one another to allow the shear expansion element 185 to move laterally in relation to the shear lug element 183, as the shear lug element 183 is urged toward the shear expansion element 185.

During use, as the spacer lug expansion screw 148 or shear lug set screw 148 is tightened, the shear lug set screw 148 is urged against the shear expansion element 185, causing the shear expansion element 185 to slide, diagonally, against at least a portion of the shear lug element 183. This maintains pressure from the shear expansion element 185 and the shear lug element 183 against the opposing, vertical surfaces of the recoil groove of the accessory attachment rail. Thus, as the spacer lug screw or shear lug set screw 148 is threaded into the main chassis 110, adjacent, angled planes or surfaces of the shear lug element 183 and the shear expansion element 185 interact to expand the expandable spacer lug 180 within the recoil groove.

In various exemplary embodiments, various components of the accessory attachment device 100 are substantially rigid and are formed of steel. Alternate materials of construction of the various components of the accessory attachment device 100 may include one or more of the following portion: stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the accessory attachment device 100 is a design choice based on the desired appearance and functionality of the accessory attachment device 100.

It should be appreciated that certain elements of the accessory attachment device 100 may be formed as an integral unit. Alternatively, suitable materials can be used and sections or elements of the accessory attachment device 100 may be made independently and attached or coupled together, such as by adhesives, welding, screws, bolts, rivets, pins, or other fasteners, to form the accessory attachment device 100.

While the exemplary representative accessory attachment device 100 is illustrated as including an optic mount extending upward from the main chassis 110, it should be appreciated that the main chassis 110 may extend to any desired mount or attachment or may be formed as an integral component of a desired device or accessory.

Thus, it should be understood that the configuration of the main chassis 110 is a design choice based upon the desired functionality and or interoperability of the accessory attachment device 100 of the present disclosure.

While this disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawing portions. This statement is intended to serve as antecedent basis for use of such exclusive terminology as "solely", "only", and the like in connection with the recitation of claim elements or the use of a "negative" claim limitation(s).

What is claimed is:

1. An accessory attachment device, comprising:

a main chassis;

a first locking arm and a second locking arm extending from said main chassis;

a channel defined between said first locking arm and said second locking arm;

a rail clamp having a clamp extension, wherein said rail clamp is slidably positioned within at least a portion of a rail clamp aperture formed through said second locking arm, and wherein said rail clamp is slidable between an extended or engaged position wherein at least a portion of said clamp extension extends through at least a portion of said rail clamp aperture and a retracted or disengaged position wherein said clamp extension is at least partially retracted from said channel;

a tension arm, wherein at least a portion of said tension arm is pivotably positioned within a chassis recess formed in at least a portion of said main chassis;

a cam lever having a cam lever extension portion, wherein at least a portion of said cam lever is pivotably positioned within said tension arm, wherein said cam lever is pivotable between an open or unlocked position and a closed or locked position, and wherein if said cam lever is pivoted toward said closed or locked position, said cam lever extension portion is urged against said rail clamp and said clamp extension is urged into said channel; and a spacer lug positioned within said channel, wherein said spacer lug can be engaged by a spacer lug expansion screw such that if said spacer lug expansion screw is tightened, at least a portion of said spacer lug expands.

2. The accessory attachment device of claim 1, wherein if said cam lever is pivoted toward said open or unlocked position, said cam lever extension portion is urged away from said rail clamp and said clamp extension is at least partially retracted from said channel.

3. The accessory attachment device of claim 1, wherein if said cam lever is pivoted toward said open or unlocked position, said cam lever extension portion is urged away from said rail clamp and said clamp extension is fully retracted from said channel.

4. The accessory attachment device of claim 1, wherein said spacer lug comprises a spacer lug expansion slot formed through at least a portion of said spacer lug, and wherein said spacer lug can be engaged by said spacer lug expansion screw such that if said spacer lug expansion screw is tightened, at least a portion of said spacer lug proximate said spacer lug expansion slot expands.

5. The accessory attachment device of claim 1, wherein said spacer lug comprises a resilient portion of material, and wherein said spacer lug can be engaged by said spacer lug expansion screw such that if said spacer lug expansion screw is tightened, at least a portion of said spacer lug expands.

6. The accessory attachment device of claim 1, wherein said spacer lug comprises a shear expansion element and a spacer lug element and wherein said shear expansion element can be engaged by said spacer lug expansion screw such that if said spacer lug expansion screw is tightened, adjacent, angled planes or surfaces of said spacer lug element and said shear expansion element interact to expand said expandable spacer lug.

7. An accessory attachment device, comprising:

a main chassis;

a first locking arm and a second locking arm extending from said main chassis;

a channel defined between said first locking arm and said second locking arm;

a rail clamp having a clamp extension, wherein said rail clamp is slidably positioned within at least a portion of a rail clamp aperture formed through said second locking arm, and wherein said rail clamp is slidable between an extended or engaged position wherein at least a portion of said clamp extension extends through at least a portion of said rail clamp aperture and a retracted or disengaged position wherein said clamp extension is at least partially retracted from said channel;

a cam lever having a cam lever extension portion, wherein at least a portion of said cam lever is pivotably positioned relative to said main chassis, wherein said cam lever is pivotable between an open or unlocked position and a closed or locked position, and wherein if said cam lever is pivoted toward said closed or locked position, said cam lever extension portion is urged against said rail clamp and said clamp extension is urged into said channel; and a spacer lug positioned within said channel, and wherein said spacer lug comprises a shear expansion element and a spacer lug element and wherein said shear expansion element can be engaged by a spacer lug expansion screw such that if said spacer lug expansion screw is tightened, adjacent, angled planes or surfaces of said spacer lug element and said shear expansion element interact to expand said expandable spacer lug.

8. The accessory attachment device of claim 7, wherein if said cam lever is pivoted toward said open or unlocked position, said cam lever extension portion is urged away from said rail clamp and said clamp extension is at least partially retracted from said channel.

9. The accessory attachment device of claim 7, wherein if said cam lever is pivoted toward said open or unlocked position, said cam lever extension portion is urged away from said rail clamp and said clamp extension is fully retracted from said channel.

10. An accessory attachment device, comprising:

a main chassis;

a first locking arm and a second locking arm extending from said main chassis;

a channel defined between said first locking arm and said second locking arm;

a rail clamp having a clamp extension, wherein said rail clamp is slidably positioned within at least a portion of a rail clamp aperture formed through said second locking arm, and wherein said rail clamp is slidable between an extended or engaged position wherein at least a portion of said clamp extension extends through at least a portion of said rail clamp aperture and a retracted or disengaged position wherein said clamp extension is at least partially retracted from said channel;

a cam lever having a cam lever extension portion, wherein at least a portion of said cam lever is pivotably positioned relative to said main chassis, wherein said cam lever is pivotable between an open or unlocked position and a closed or locked position, and wherein if said cam lever is pivoted toward said closed or locked position, said cam lever extension portion is urged against said rail clamp and said clamp extension is urged into said channel; and a spacer lug, wherein said spacer lug is positioned within said channel, wherein said spacer lug can be engaged by a spacer lug expansion screw such that if said spacer lug expansion screw is tightened, at least a portion of said spacer lug expands, and wherein said spacer lug comprises a shear expansion element and a spacer lug element and wherein said shear expansion element can be engaged by a spacer lug expansion screw such that if said spacer lug expansion screw is tightened, adjacent, angled planes or surfaces of said spacer lug element and said shear expansion element interact to expand said expandable spacer lug.

11. The accessory attachment device of claim 10, wherein if said cam lever is pivoted toward said open or unlocked position, said cam lever extension portion is urged away from said rail clamp and said clamp extension is at least partially retracted from said channel.

12. The accessory attachment device of claim 10, wherein if said cam lever is pivoted toward said open or unlocked position, said cam lever extension portion is urged away from said rail clamp and said clamp extension is fully retracted from said channel.

* * * * *